US005808249A

United States Patent [19]

Francis, Jr. et al.

[11] Patent Number: 5,808,249

[45] Date of Patent: Sep. 15, 1998

[54] CIRCUIT BREAKER WITH IMPROVED IMPACT RESISTANCE

[75] Inventors: Donald Charles Francis, Jr.; Randall Luther Siebels; Brett Eugene Larson, all of Cedar Rapids, Iowa

[73] Assignee: Square D Company, Palatine, Ill.

[21] Appl. No.: 627,748

[22] Filed: Apr. 2, 1996

[51] Int. Cl.[6] ..... H01H 3/00; H01H 21/00

[52] U.S. Cl. ..... 200/17 R; 200/553; 200/339

[58] Field of Search ..... 200/17 R, 18, 200/402–472, 335, 337, 339, 535–571

[56] References Cited

U.S. PATENT DOCUMENTS

| | | | |
|---|---|---|---|
| 4,623,859 | 11/1986 | Erickson et al. | 335/14 |
| 4,794,356 | 12/1988 | Yu et al. | 335/13 |
| 4,796,844 | 1/1989 | Barker | 248/222.2 |
| 4,831,221 | 5/1989 | Yu et al. | 200/553 |
| 4,864,263 | 9/1989 | Castonguay et al. | 335/167 |
| 4,912,439 | 3/1990 | Nagy et al. | 335/132 |
| 5,003,139 | 3/1991 | Edds et al. | 200/401 |
| 5,083,103 | 1/1992 | Winter et al. | 355/14 |
| 5,140,115 | 8/1992 | Morris et al. | 200/308 |
| 5,172,088 | 12/1992 | Morgan | 335/201 |
| 5,180,051 | 1/1993 | Cook et al. | 200/400 |
| 5,252,937 | 10/1993 | Bernier et al. | 335/202 |
| 5,272,591 | 12/1993 | Blue et al. | 361/622 |
| 5,272,592 | 12/1993 | Harris et al. | 361/637 |
| 5,301,083 | 4/1994 | Grass et al. | 361/64 |
| 5,302,787 | 4/1994 | Edds et al. | 200/464 X |
| 5,357,071 | 10/1994 | Hanaki | 200/339 X |
| 5,404,266 | 4/1995 | Orchard | 361/667 |
| 5,418,683 | 5/1995 | Orchard et al. | 361/672 |
| 5,430,419 | 7/1995 | Scheel et al. | 335/16 |

*Primary Examiner*—J. R. Scott

*Attorney, Agent, or Firm*—Larry I. Golden; Kareem M. Irfan

[57] ABSTRACT

The present invention provides a circuit breaker assembly having a base, cover, and switch handle adapted to withstand an external force applied to a lever of the switch handle. During normal operation the handle rotates on small-diameter pivots in elongated bearing slots. Under abnormal conditions that occur when the lever of the switch handle is inadvertently struck, such as when the circuit breaker is dropped on the lever of the switch handle, the pivots slide in the elongated bearing slots. The force is borne by large-diameter hubs which come in contact with mating bearing surfaces. Thus, the pivots are not shorn off during such incidents, which would damage the circuit breaker.

8 Claims, 6 Drawing Sheets

CIRCUIT BREAKER WITH IMPROVED IMPACT RESISTANCE

BACKGROUND OF THE INVENTION

1. Field of the Invention

This invention relates generally to electric circuit breakers and more particularly to circuit breakers with improved impact resistance.

2. Description of the Related Art

Circuit breakers are commonly used for temporary interruption of electrical power to electrical devices (loads). Various circuit breaker mechanisms have evolved and have been perfected over time on the basis of application-specific factors such as current capacity, response time, and the type of reset (manual or remote) function desired of the breaker.

One type of circuit breaker mechanism employs a thermo-magnetic tripping device to trip a latch in response to a specific range of over-current conditions. In another type of circuit breaker, referred to as a double-break circuit breaker, two sets of current breaking contacts are included to accommodate a higher level of over-current conditions than can be handled by one set of contacts. The mechanical and electrical assembly that is typical of those used in circuit breakers of the present invention have been described before. For this reason U.S. Pat. No. 5,430,419 is incorporated herein by reference in its entirety.

In general, the present invention pertains to the durability and impact resistance of circuit breakers. Prior art circuit breakers, as described below with reference to FIG. 1, have smooth opposing planar sides with a small-diameter pivot extending from each side. If the prior art circuit breaker were accidentally dropped on the lever extending from the handle, the pivots may shear off. Alternatively, the lever may receive a blow in some other manner. In any case, there is a risk that the pivots may break, allowing the handle to be jammed into the internal electro-mechanical assembly. If this happens, the circuit breaker is ruined and/or rendered inoperable and must be replaced. Thus, it is desirable to have a circuit breaker with improved durability and impact resistance.

SUMMARY OF THE INVENTION

The present invention provides a circuit breaker for interrupting power in a circuit path between a source and a load. The circuit breaker includes an electro-mechanical assembly including first and second contacts cooperatively arranged in the circuit path for providing current from the source to the load, wherein at least one of the contacts is movable for interrupting the power provided to the load. A pivotable integral switch handle is operatively connected to the electro-mechanical assembly for making and breaking the circuit path.

The switch handle has a body. The body has curved sides and opposing first and second planar sides and a lever extending from a curved side. A first hub extends from the first planar side and forms a first shoulder with the first planar side. A second hub extends from the second planar side and forms a second shoulder with the second planar side. A first pivot extends from the first hub, and a second pivot extends from the second hub.

The circuit breaker further includes a base and a cover adapted to receive the electro-mechanical assembly and the handle. The base has a first elongate bearing slot adapted to receive the first pivot. The cover has a second elongate bearing slot adapted to receive the second pivot. Preferably, the base has a first bearing surface adapted to receive the first shoulder, and the cover has a second bearing surface adapted to receive the second shoulder.

In a preferred embodiment, the circuit breaker further comprises first and second projections formed integral with a curved side of the body. Preferably, the first and second projections have opposing first and second bearing forks. A blade engages the first and second bearing forks, and a spring engages the blade, in a preferred embodiment. Preferably, the first and second elongate bearing slots have opposing ends and the blade and spring cooperate to press the first and second pivots against one end of the first and second elongate bearing slots. With this arrangement, when a force is applied to the lever, the first and second pivots slide in the first and second elongate bearing slots until the first and second shoulders engage the first and second bearing surfaces, respectively. This prevents the shearing or breaking of the first and second pivots, when such a force is applied. Thus, the circuit breaker is more durable.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment in conjunction with the accompanying drawings, in which like elements have been given like numerals and wherein:

FIG. 7 illustrates the normal position of a pivot in a bearing slot.

DESCRIPTION OF THE PREFERRED EMBODIMENTS

Conventional circuit breakers contain a handle for manual operation of the device. Typically, the handle rotates on a pivot. When a relatively large external force is applied along the axis of such a handle (e.g. the circuit breaker is dropped), the pivot may break because the small cross section of the pivot is unable to withstand ensuing shear stresses. The breaking of the pivot allows the handle to be pushed inside the breaker, causing internal damage to the circuit breaker, and rendering it inoperable.

Figure 1:
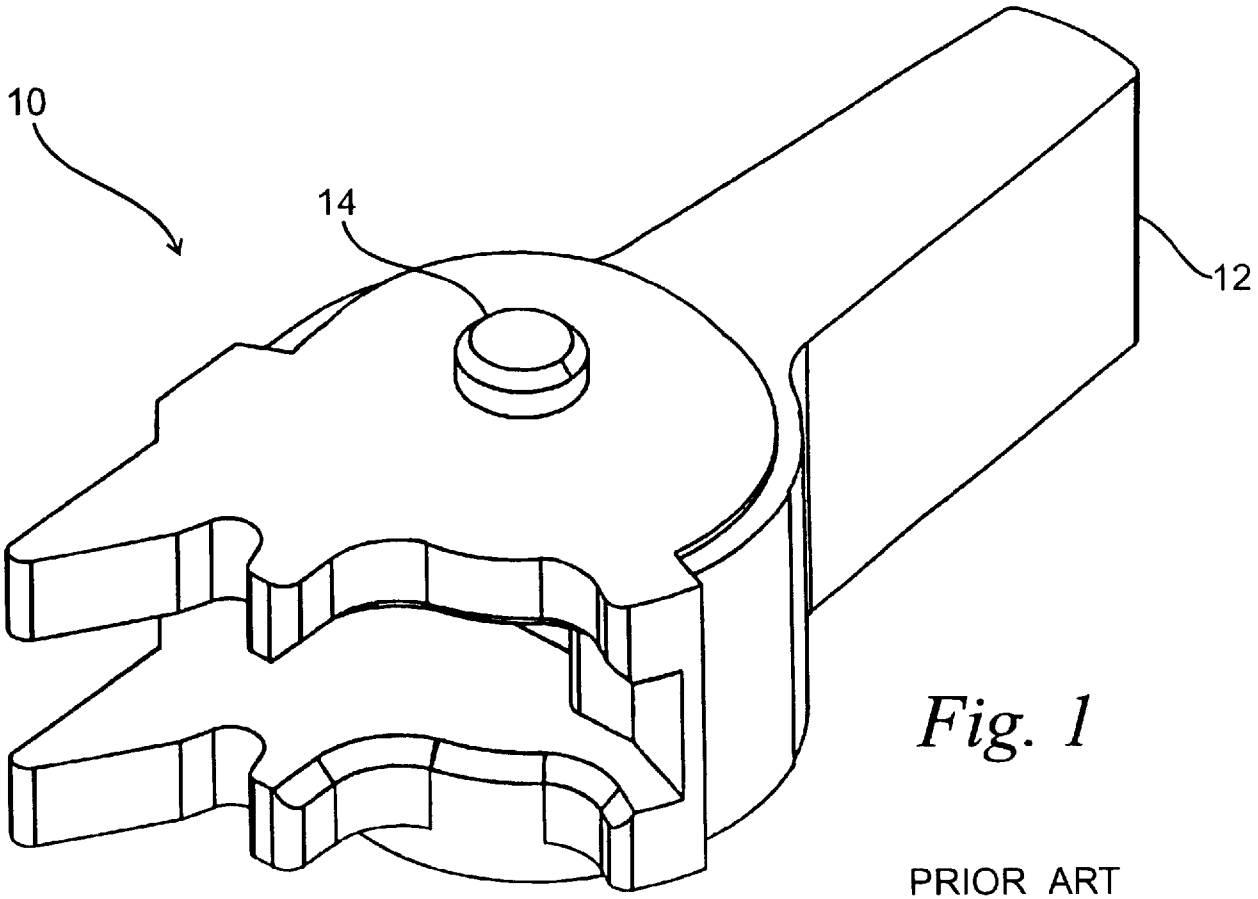
Fig. 1 PRIOR ART
FIG. 1 shows an isometric view of the handle of a circuit breaker according to the prior art.

FIG. 1 shows an isometric view of a switch handle 10 of a circuit breaker according to the prior art. Referring to FIG. 1, the handle 10 comprises a lever 12, and a pivot 14. A second opposing pivot is provided, but not shown. When a circuit breaker having a prior art handle 10 is inadvertently dropped on the handle 10, the pivots 14 tend to shear off. This allows the handle 10 to be pushed inside the breaker, causing damage to the assembly within and rendering the circuit breaker inoperable.

Figure 2:
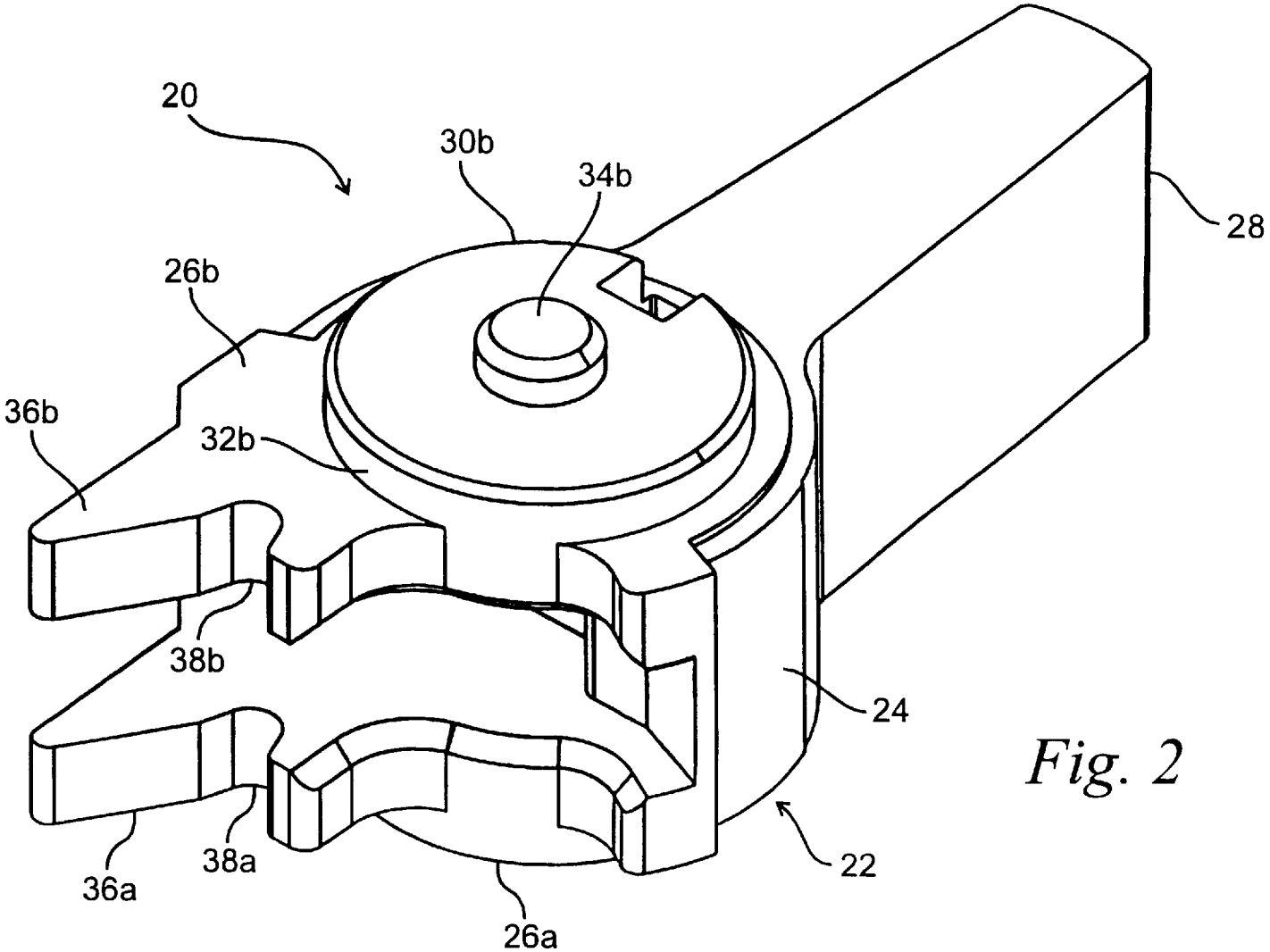
FIG. 2 shows an isometric view of the handle of a circuit breaker according to the present invention.
Figure 3:
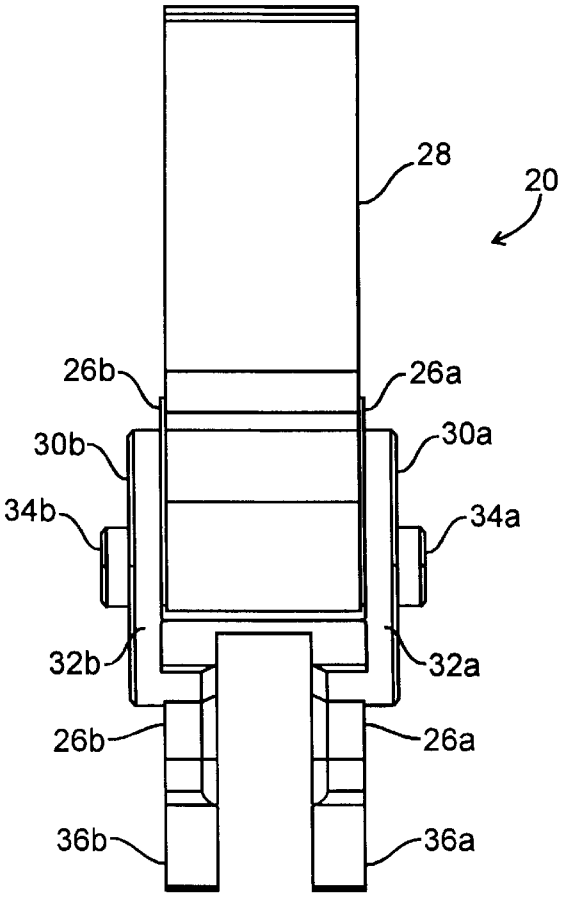
FIG. 3 shows an elevation of the handle of FIG. 2.

FIG. 2 shows an isometric view of a switch handle 20 of a circuit breaker according to the present invention, and FIG. 3 shows an elevation of the same. The handle 20 comprises a body 22, curved sides 24, and planar sides 26*a*, 26*b*. A lever 28 provides a means of pivoting the handle 20. Unlike the prior art, hubs 30*a*, 30*b* project or extend from the planar sides 26. Like elements differentiated by an alpha character are referenced solely by the numeric identifier when differentiation is unnecessary. The hubs 30 form shoulders 32*a*, 32*b* with the planar sides 26. Pivots 34*a*, 34*b* extend or project from the hubs 30*a*, 30*b*, respectively. Forked projections 36*a*, 36*b* are formed integral with the body 22. The forked projections 36*a*, 36*b* have opposing first and second bearing forks 38*a*, 38*b*.

Figure 4:
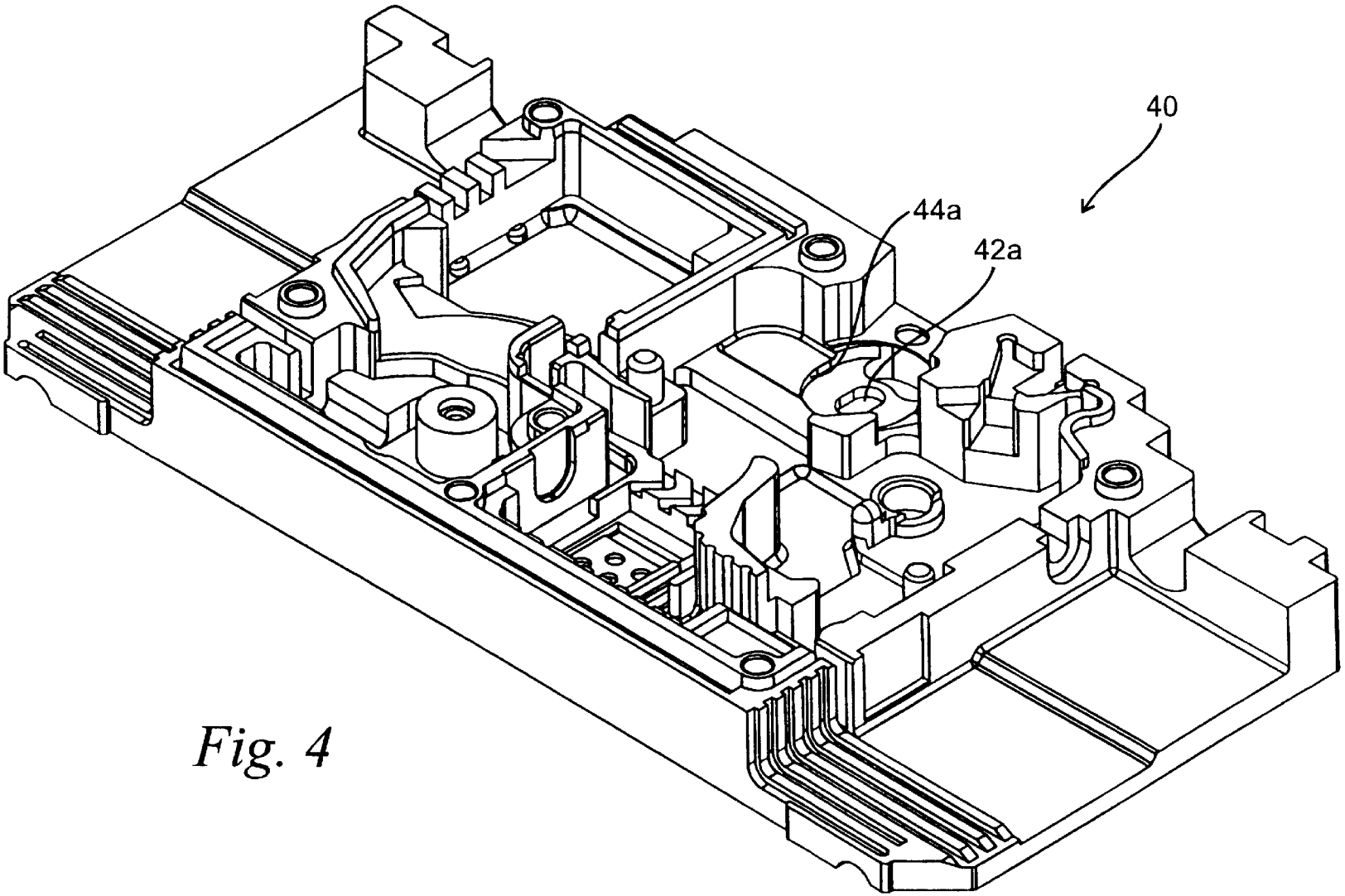
FIG. 4 shows an isometric view of the base of a circuit breaker housing according to the present invention.

FIG. 4 shows an isometric view of a base 40 of the housing of a circuit breaker according to the present invention. The base 40 is adapted to receive an electro-mechanical assembly (discussed below) and the handle 20. An elongated bearing 42*a* is recessed into the base 40 to receive the pivot 34*a*. The base 40 has a bearing surface 44*a* adapted to receive the shoulder 32*a*. Likewise, as shown in an isometric view in FIG. 5, a circuit breaker has a cover 50 adapted to receive the electro-mechanical assembly discussed below and the handle 20. An elongated bearing slot 42*b* is recessed into the cover 50 to receive the pivot 34*b*. The cover 50 has a bearing surface 44*b* adapted to receive the shoulder 32*b*.

Figure 6:
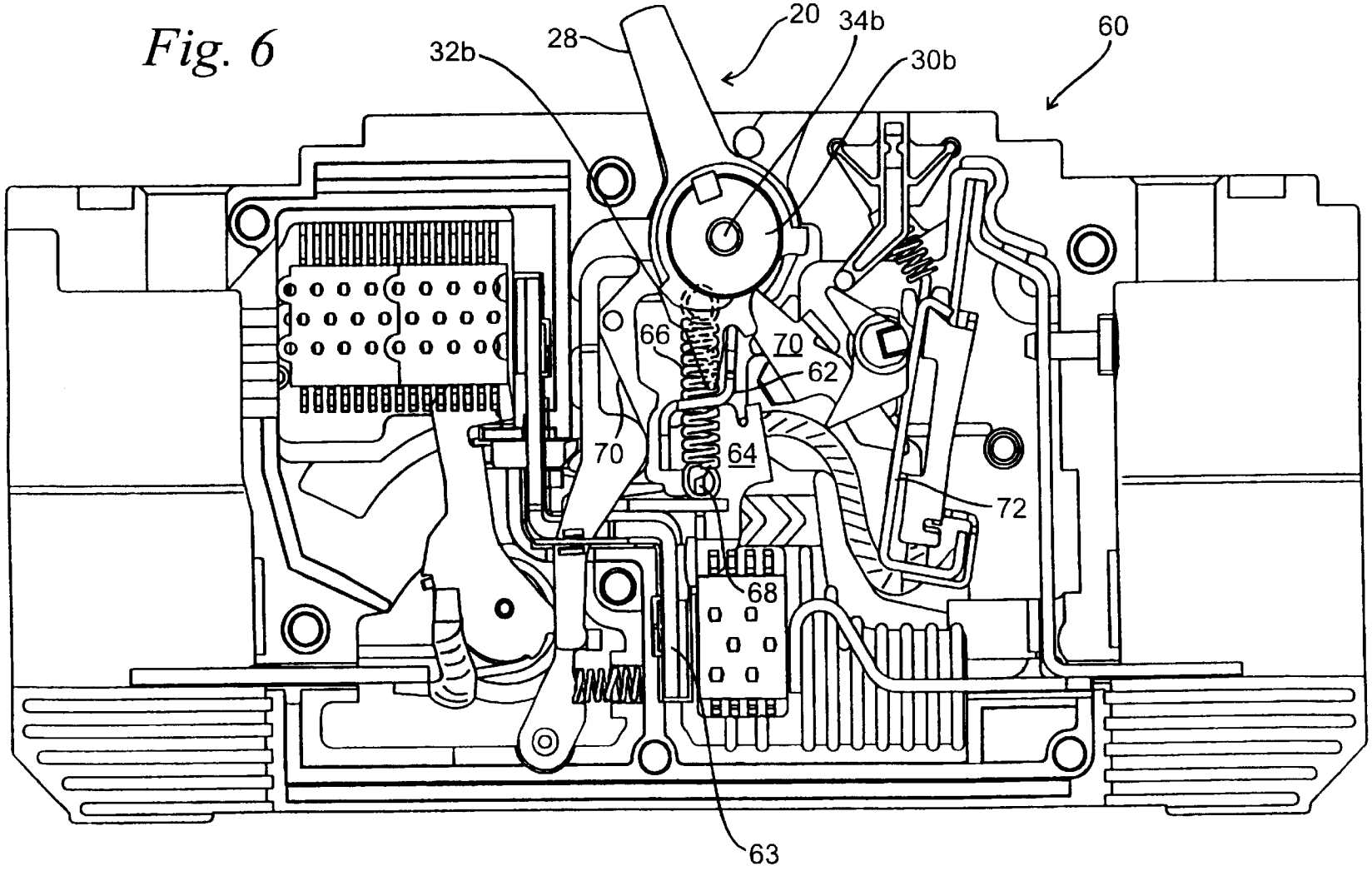
FIG. 6 shows a plan view of a base assembly of a circuit breaker with its electro-mechanical assembly and handle according to the present invention.

FIG. 6 shows a plan view of a base assembly 60 of a circuit breaker with its electro-mechanical assembly and handle 20 according to present invention. Although, FIG. 6 shows several details of the circuit breaker base assembly 60, only a limited discussion of the various components are discussed herein. As discussed earlier, U.S. Pat No. 5,430,419 provides a detailed discussion of a circuit breaker and is incorporated herein by reference. That patent is assigned to the present assignee, as well, and should be referenced for a more detailed discussion of the operation of a circuit breaker. The base assembly 60 contains a stationary contact 63 and a mating rotatable blade contact 62. The rotatable blade contact 62 is welded to a blade 64. The blade 64 rotates in the first and second bearing forks 38*a*, 38*b* in response to manual operation of the handle 20 or a trip of the circuit breaker. The contact blade 62 is biased by an extension spring 66 which is secured at one end to a retaining member 68 of the contact blade 62 and at the other end to a retaining member (not shown) on the trip lever 70. The trip lever 70 is latched by the magnetic armature 72. Upon manual rotation of the lever 28, the contact blade 62 either opens or closes the circuit via the movable contact 62 and the stationary contact.

Figure 7:
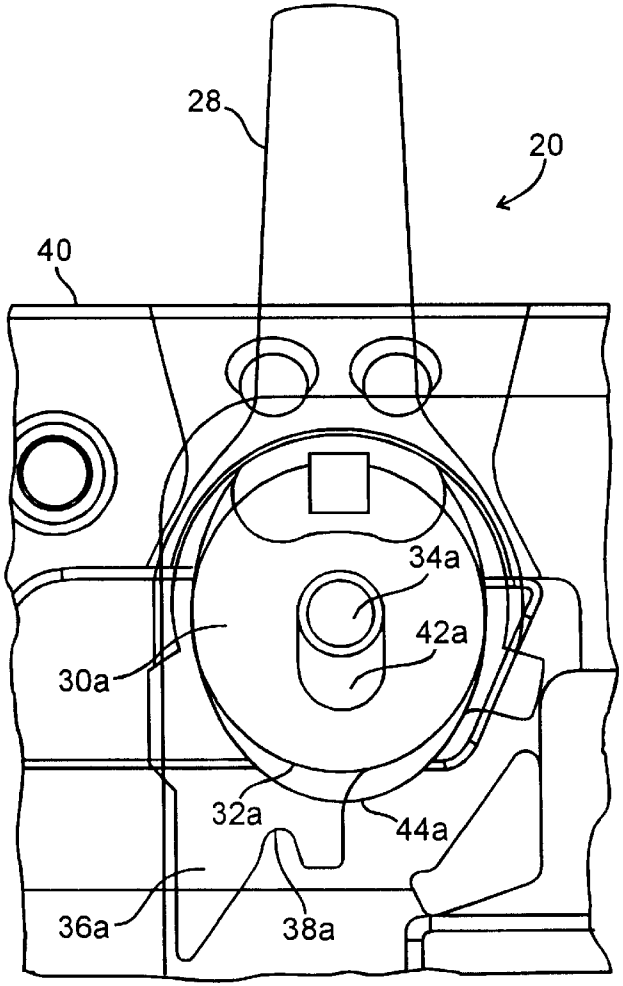
FIG. 7 is a cross-section of a base and handle as would be seen in the reverse direction of the plan view in FIG. 6.
Figure 5:
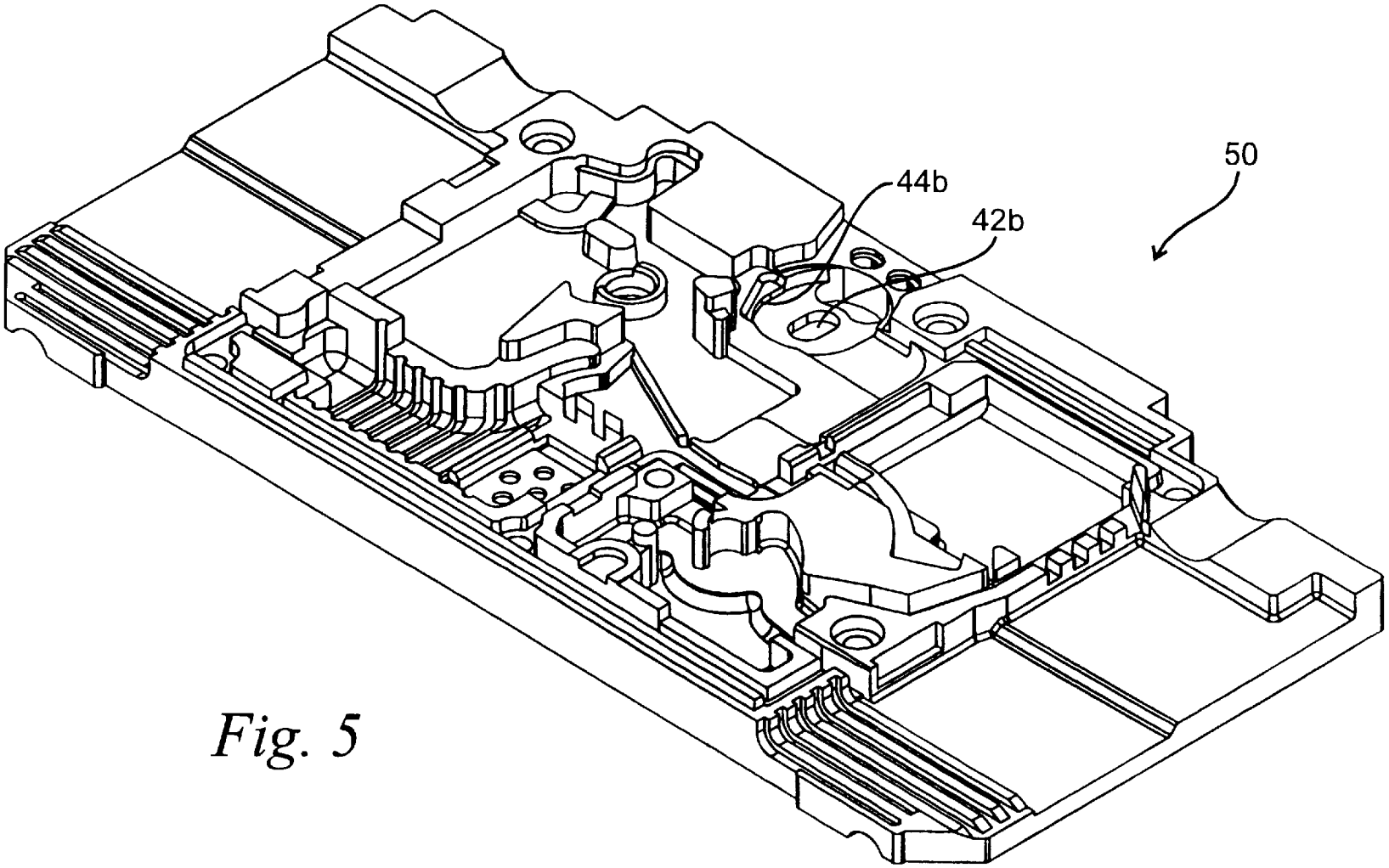
FIG. 5 shows an isometric view of the cover of a circuit breaker housing according to the present invention.

FIG. 7 illustrates the normal position of the pivot 34 in the bearing slot 42. FIG. 7 is a cross-section of a base and handle as would be seen in the reverse direction of the plan view in FIG. 6. The pivot 34 is normally pressed against one end of the bearing slot 42. This is the normal position because the spring 66 forces the blade 62 into the bearing forks 38, which pushes the body 22 until the pivots 34 rest against one end of the elongated bearing slots 42. However, as best seen in FIGS. 4 and 5, if a force is applied to the lever 28 in the direction of the body 22, the pivots 34 will slide within the elongated bearing slots 42 until the shoulders 32 contact the bearing surfaces 44. In this manner the force is distributed over the bearing surfaces 44 rather than being absorbed by the pivots 34. The radius of the bearing surfaces 44 matches with the radius of the shoulders 32, distributing such a force over a greater area than can be provided by the pivots 34 and a circular bearing recess for the pivots.

Because of the described motion of the pivots 34, a force applied on the lever 28 does not cause shearing action on the pivot 34, but instead transfers the applied load to the base bearing surface 44*a* and the cover bearing surfaces 44*b*. The sum of the areas of the base bearing surface 44*a* and the cover bearing surfaces 44*b* are much larger than that of the contact area of pivots in circular bearings. Also, the diameter of the hubs 30 are sufficiently great to withstand a shearing force when a force is applied to the handle 20 via the lever 28. In normal operation, only the friction of the small pivot 34 is experienced because the shoulder 32 is not in contact with the bearing surface 44. Yet, when needed to withstand a blow, the hub 30 takes the stress as the shoulder 32 moves into contact with the bearing surface 44, while the pivot 34 slides out of harm's way.

Typically, the handle 20, base 40, and cover 50 are molded in a thermoset material. The electro-mechanical assembly is assembled onto and into the base 40. The switch handle 20 is installed concurrently with the electro-mechanical assembly. The pivot 34*a* is inserted into the elongated bearing slot 42*a*. The blade 62 is fitted into the bearing forks 38. The cover 50 is assembled onto the base 40 taking care to align the pivot 34*b* into the elongated bearing slot 42*b*. Generally, the cover 50 is riveted to the base 40 after the internal components are assembled. The completed circuit breaker assembly can be shipped for field installation or be installed at the factory. In any case the circuit breaker built according the present invention is durable and impact resistant. The switch handle 20 can withstand a significant amount of force without breakage. Since the hubs 30 are strong, it is preferable that the bearing surfaces 44 be molded into a sufficiently substantial structure so that the system of hubs 30, shoulders 32 and bearing surface 44 can withstand a significant impact.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A circuit breaker for interrupting power in a circuit path between a source and a load, comprising:

(a) an electro-mechanical assembly including first and second contacts cooperatively arranged in the circuit path for providing current from the source to the load, wherein at least one of the contacts is movable for interrupting the power provided to the load;

(b) a pivotable integral switch handle operatively connected to the electro-mechanical assembly for making and breaking the circuit path, the handle having:

a body having curved sides and opposing first and second planar sides, a lever extending from a curved side, a first hub extending from the first planar side and forming a first shoulder therewith, a first pivot extending from the first hub, (c) a base coupled to the electro-mechanical assembly and the handle, the base having a first elongate bearing slot in contact with, the first pivot; and (d) a cover coupled to the electro-mechanical assembly and the handle, and coupled to the base, the cover having a second elongate bearing slot, a second pivot reposing in the second elongate bearing slot.

2. The circuit breaker of claim 1 further comprising a second hub extending from the second planar side and forming a second shoulder therewith.

3. The circuit breaker of claim 2 further comprising a second pivot extending from the second hub.

4. The circuit breaker of claim 3 wherein the base has a first bearing surface adapted to receive the first shoulder, and the cover has a second bearing surface adapted to receive the second shoulder.

5. The circuit breaker of claim 4 further comprising first and second projections formed integral with a curved side of the body, the first and second projections having opposing first and second bearing forks.

6. The circuit breaker of claim 5, further comprising a blade engaged with the first and second bearing forks.

7. The circuit breaker of claim 6, further comprising a spring engaged with the blade.

8. The circuit breaker of claim 7, wherein the first and second elongate bearing slots have opposing ends and the blade and spring cooperate to press the first and second pivots against one end of the first and second elongate bearing slots, so that when a force is applied to the lever, the first and second pivots slide in the first and second elongate bearing slots until the first and second shoulders engaged the first and second bearing surfaces, respectively, preventing a shear force on the first and second pivots.

* * * * *